United States Patent [19]

Bedell et al.

[11] 3,964,535

[45] June 22, 1976

[54] STOPPER ROD TAPPING ASSEMBLY AND FILAMENT FORMING PROCESS

[75] Inventors: John R. Bedell, Sparta; Robert W. Smith, Flanders, both of N.J.

[73] Assignee: Allied Chemical Corporation, New York, N.Y.

[22] Filed: Feb. 20, 1975

[21] Appl. No.: 551,557

[52] U.S. Cl. ..... 164/66; 164/82; 164/259; 164/281 R

[51] Int. Cl.[2] ..... B22D 11/10

[58] Field of Search ..... 164/64, 66, 82, 259, 164/281; 266/34 PP, 38; 222/3, 4, 5, 21, DIG. 3

[56] References Cited

UNITED STATES PATENTS

| | | | |
|---|---|---|---|
| 3,200,457 | 8/1965 | Wagstaff | 222/DIG. 3 |
| 3,503,597 | 3/1970 | Kessler et al. | 266/34 PP |
| 3,565,412 | 2/1971 | Moniot | 266/34 PP |
| 3,886,992 | 6/1975 | Maas et al. | 164/66 X |

*Primary Examiner*—Robert D. Baldwin

*Attorney, Agent, or Firm*—David W. Collins; Arthur J. Plantamura

[57] ABSTRACT

A stopper rod tapping assembly for bottom tapping of a crucible to extrude molten metal through a tapping orifice is described. The stopper rod has an interior vent, providing communication of a pressurized inert gas from above the melt to the tapping orifice in the bottom of the crucible. The vent permits flushing of the tapping orifice between tapping runs to prevent buildup of residues in the tapping orifice which would otherwise adversely affect the tapping operation. The assembly is advantageously used in casting filaments from the molten metal.

2 Claims, 2 Drawing Figures

STOPPER ROD TAPPING ASSEMBLY AND FILAMENT FORMING PROCESS

BACKGROUND OF THE INVENTION

1. Field of the Invention

The invention is related to stopper rod tapping assemblies, and, in particular, to a stopper rod tapping assembly used in casting filaments from molten metal sources.

2. Description of the Prior Art

Bottom pouring or tapping of molten metal from crucibles is well-known in the steel industry for eliminating some of the disadvantages related to top pouring. As used herein, the term "metal" includes metal alloys. A variety of bottom tapping assemblies have been utilized; one such assembly is the well-known stopper rod tapping assembly. In this technique, a vertical standing rod is seated against a tapping orifice in the bottom of the crucible while the metal in the crucible is brought to a temperature sufficient for casting a molten stream. At that time, the stopper rod is lifted, and the molten metal exits from the crucible through the tapping orifice. Often, it is convenient in processing certain metal alloys to seal the crucible in some fashion and to provide a protective atmosphere over the surface of the melt, thereby preventing any adverse chemical reactions, such as with oxygen, from occurring. This technique is often used, for example, in casting amorphous metal alloy filaments directly from the melt. Typically, these amorphous metal alloys contain about 75 to 85 atom percent transition metals and about 15 to 25 atom percent metalloids; many of these elements react with oxygen. It is often convenient in sealing the crucible to provide both a gas inlet and a gas outlet to enable inert gas, such as argon, to be introduced under flowing conditions above the surface of the melt. Closing the gas outlet and lifting the stopper rod substantially simultaneously enables an over-pressure of inert gas to be built up over the surface of the melt in order to expel the melt through the tapping orifice at a controlled rate.

In general, when the tapping or jetting of molten metal through a nozzle is intentionally interrupted, as by the temporary closing of a valve, residues of the molten metal tend to remain in the nozzle orifice. Such molten metal residues may then become oxidized by the ambient atmosphere to which it is exposed and form solid oxide residues which then interfere with or prevent subsequent jetting of the molten metal when the valve is reopened. In the case of bottom tapping where the stopper rod serves as the valve, this buildup of residues poses a difficult problem, especially where it is desired to control the rate of extrusion, as in the casting of metal alloy filaments.

SUMMARY OF THE INVENTION

In accordance with the invention, a stopper rod tapping assembly for bottom tapping of molten metal through a tapping orifice in the bottom of a sealed crucible containing the molten metal and through which an inert gas is passed under pressure comprises (a) a stopper rod having an interior vent extending from above the surface of the molten metal to the bottom of the stopper rod, (b) means for raising and lowering the stopper rod and (c) a valve seat surrounding the orifice for seating the stopper rod and closing the orifice. When the stopper rod is seated against the valve seat of the tapping orifice, the vent provides communication of the pressurized inert gas from above the melt to the tapping or jetting orifice below the melt. The vented geometry enables the tapping orifice to be flushed with the inert gas from above the melt, removing unwanted residues from the tapping orifice without disrupting the melt. The venting of the stopper rod automatically ceases when the rod is raised and melt is extruded through the tapping orifice, and the venting and flushing resumes when the stopper rod is again lowered against the valve seat of the orifice.

DETAILED DESCRIPTION OF THE INVENTION

The description that follows is conveniently given in terms of casting or extruding a filament of molten metal alloy to form an amorphous metal alloy filament. It will be clear to those skilled in the art, however, that the same apparatus is useful for casting filaments, whether crystalline or amorphous, metal or metal alloy, which utilize sealed crucibles and over-pressure of a non-reactive atmosphere to extrude the melt. Typical metals and metal alloys include copper metal, silver-gold alloys and iron-phosphorous-boron-carbon alloys.

Figure 1:
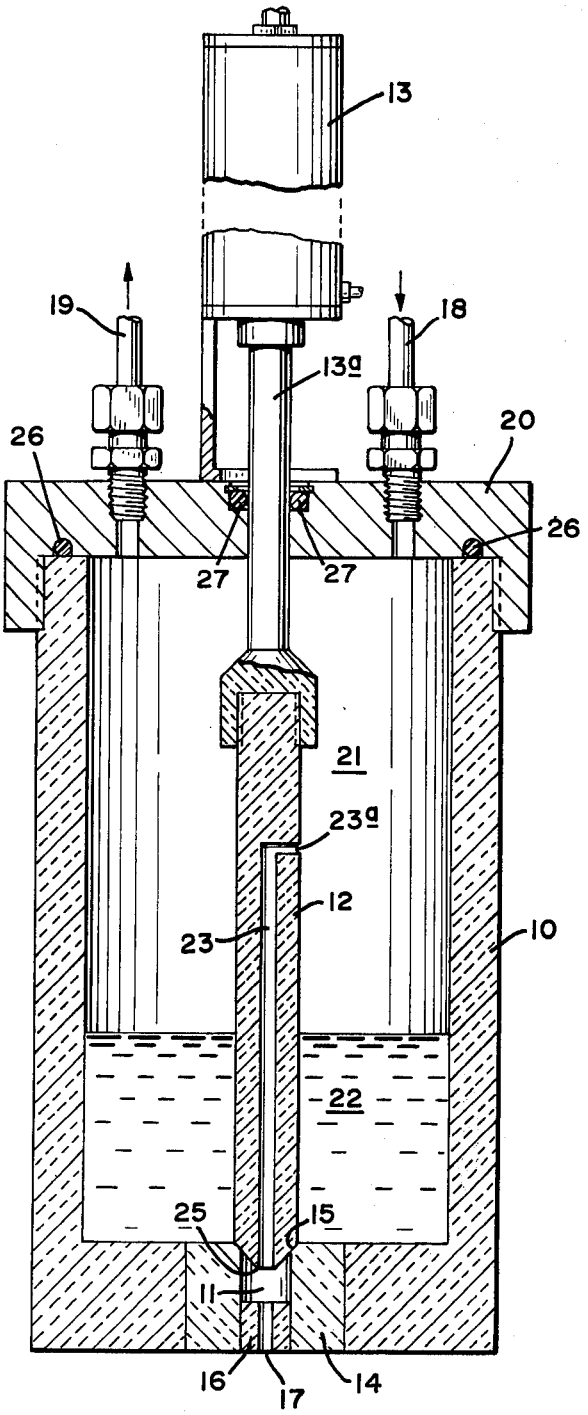
FIG. 1 in cross section illustrates a stopper rod tapping assembly for bottom tapping of a crucible, with the stopper rod seated against the valve seat of the bottom orifice in the closed position.
Figure 2:
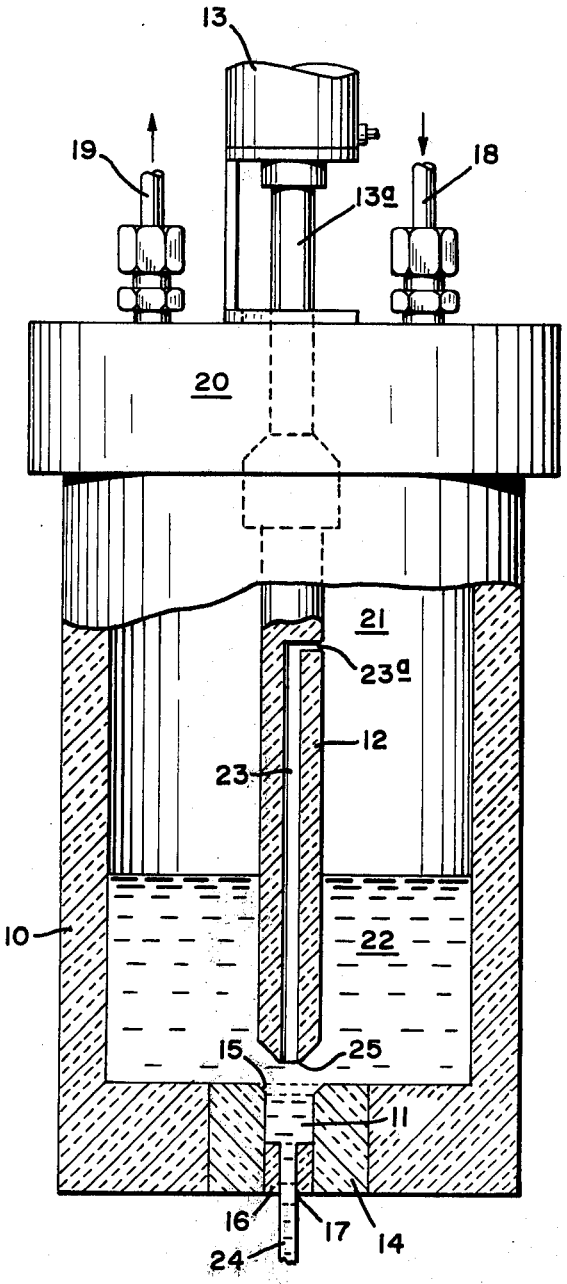
FIG. 2 in cross section illustrates the stopper rod tapping assembly, with the stopper rod raised, during extrusion of molten metal.

The invention is more clearly depicted in FIGS. 1 and 2, which illustrate a crucible 10 provided with a bottom tapping orifice 11. A stopper rod tapping assembly comprises a stopper rod 12, means 13 for raising and lowering the stopper rod, and a valve seat 14 for seating the stopper rod against the tapping orifice along a mating surface 15. A nozzle 16 having an opening 17 controls the diameter of the molten jet of material being extruded. Means (not shown) for heating material to form a melt 22 of molten metal surround the crucible. Such means for heating material may comprise a conventional rf coil, for example. A gas inlet 18, a gas outlet 19, and a sealing top 20 enable pressurized gas to be introduced into space 21 above the melt. The stopper rod is provided with an interior channel 23, terminating at tip 25 of the stopper rod, which permits communication, through egress vent **23*a*, of the gas phase in space 21 above the melt in the crucible with the bottom tapping orifice 11. When the stopper rod is seated against the valve seat 14, pressurized gas, such as argon, helium, nitrogen, etc., which is inert with respect to the melt, crucible, valve seat and nozzle, is directed down the channel and through the bottom tapping orifice. Any residues in the orifice are flushed by the passage of the gas, preventing both entry of the ambient atmosphere and liquid closure of the orifice, thereby keeping the orifice open. When the stopper rod is raised from the valve seat, as shown in FIG. 2, the molten metal departs through the nozzle 16 as jet 24. The inert gas then ceases to pass through the channel 23 in the stopper rod because the pressure exerted by the molten metal in the vicinity of the tip 25 of the stopper rod is approximately equal to the sum of the pressure of the inert gas in the gas space 21** and the product of the melt depth times its density, whereas the pressure available to force the inert gas down the channel is only equal to the pressure of the inert gas in the gas space.

After the stopper rod again is seated against the valve seat, the melt 22 ceases to flow, as shown in FIG. 1. At this time, the tip 25 of the stopper rod is no longer exposed to the melt, and gas is again able to flow through the channel, thereby flushing and clearing the tapping orifice of unwanted residues, thereby preventing such residues from accummulating. The apparatus in accordance with the invention keeps both the orifice 11 and the nozzle opening 17 clear of molten residues of prior to extruding a filament from the melt, and excludes entry of ambient air and therefore prevents oxidation of any molten metal trapped along the mating surface 15. The flow of inert gas is maintained continuously and blows out any molten metal which inadvertently is in the orifice prior to the start of the extrusion or remains in the orifice at the completion of the extrusion. During operation, that is, during the extrusion of the molten metal to form a filament, the pressure of the molten metal in the orifice is greater than the applied inert gas pressure. Thus, the over-pressure on the surface of the melt does not disrupt the molten stream 24 and thus there is an automatic shutoff of the flow of inert gas through the stopper rod assembly.

The stopper rod tapping assembly permits periodic flushing of the orifice and the nozzle. Periodic flushing, as used herein, includes flushing at the end of an extrusion run plus any interruptions from time to time during the extrusion run as may be necessary to clear the orifice and nozzle.

There are no critical limitations on the over-pressure of the inert gas used in the sealed crucible, except that the pressure should be greater than the surface tension of the molten metal and less than the sealed crucible can withstand. The over-pressure is controllable both at the gas inlet and the gas outlet by conventional gas valves (not shown).

Seating the stopper rod against the valve seat is conveniently done by mating matched beveled surfaces, as is conventional in stopper rod tapping assemblies.

The crucible and stopper rod may be fabricated from any material capable of withstanding the melt temperature and thermal stresses. Typical materials include boron nitride, graphite, alumina, silica, stabilized zirconia and beryllia. The valve seat must, in addition to the foregoing requirements, be capable of resisting sintering or welding to the stopper rod and must be machinable or formable to close dimensions, as by grinding or hot pressing, for example. Typical materials for the valve seat include boron nitride and graphite. The nozzle must be made of a material capable of withstanding the melt temperature and of resisting erosion by the melt. Typical materials for the nozzle include boron nitride, alumina and graphite. The valve seat and nozzle may be individual piece parts of the same or different composition as the crucible or, alternately, may be fabricated as part of the crucible. Individual piece parts would, of course, be slightly vertically tapered for stabilized seating.

The location of the vent egress 23*a* is not critical, so long as it remains at all times above the surface of the melt and within the crucible. The vent terminates at the tip 25 of the stopper rod.

The size of the vent 23 is also not critical, other than that it be sufficiently large to permit venting (a) without adversely affecting the structural integrity of the stopper rod and (b) without contacting the valve seat mating surface 15. It is convenient, though not necessary, to make the vent egress somewhat smaller than the vent itself. This ensures a slight positive pressure to be exerted above the melt surface at all times. This constriction, when utilized, may be introduced at any location along the vent, but is conveniently fabricated at the vent egress. As an example of dimensions conveniently employed, a stopper rod of 0.500 inch diameter is provided with a vent of 0.062 inch diameter and a vent egress of 0.020 inch diameter.

The size of the nozzle opening 17 is any dimension that is customary in forming filaments by extruding molten metal alloys, typically about 0.002 to 0.200 inch in diameter. Alternate configurations may also be employed, such as a slotted nozzle opening or an array of nozzle openings. As is well-known, parameters such as desired filament width and thickness are relevant factors in considering nozzle dimension and configuration. Where rapid quenching against a moving chill surface is utilized, as in casting amorphous or fine grain metal filaments, the rate of quenching and chill surface speed are also relevant factors. For continuous casting of molten metal into a mold, the nozzle opening typically ranges from about 0.5 to 2 inch in diameter.

The gas inlet 18 and outlet 19 are conventiently provided in the sealing top 20. The inlet and the outlet, however, may also be introduced through the side of the crucible, above the melt surface.

The means 13 for raising and lowering the stopper rod are conventional. For example, the stopper rod may be raised and lowered by hand, pneumatically, by solenoid valve or by other similar means. A shaft 13*a* conveniently couples the stopper rod to the raising and lowering means. The shaft may pass through the sealing top 20 as depicted in FIGS. 1 and 2 and may terminate inside the crucible. Alternatively, the stopper rod may pass through the sealing top and terminate outside the crucible.

O-rings 26 and 27 in the sealing top 20 enable gas pressure to be maintained above the melt surface in gas space 21. For O-rings of neoprene or similar material, the sealing top should be kept cool, as by circulating cold water. Convenient materials used for the sealing top include copper, brass and aluminum. The top may be threaded onto the crucible or held in place by clamps or by other suitable means.

EXAMPLES

1. A sealed crucible with stopper rod tapping assembly, similar to that depicted in the Drawing, was constructed. In this Example, the stopper rod passed through the sealing top. The crucible, stopper rod, valve seat and nozzle were individually fabricated from boron nitride. A variety of melts were extruded, including $Fe_{40}Ni_{40}P_{14}B_6$, $Fe_{32}Ni_{36}Cr_{14}P_{12}B_6$ and $Fe_{29}Ni_{49}P_{14}B_6Si_2$ (the subscripts are in atom percent). The crucible was 8 inch long and 3 inch in diameter; wall thickness was 0.38 inch. The stopper rod was 8.75 inch long and 0.500 inch in diameter. The vent was 0.062 inch in diameter and the vent egress was 0.020 inch in diameter. The vent extended from above the surface of the melt to the bottom tip of the stopper rod. The stopper rod was raised and lowered pneumatically.

A number of different nozzle openings were variously employed, together with various gas (argon) over-pressures. The minimum pressures required to clear the orifice were as follows: 0.015 inch opening, 0.7 psi; 0.020 inch opening, 0.5 psi; 0.035 inch opening, 0.3 psi; and 0.100 inch opening and 0.1 psi. Typically, for nozzle openings ranging from 0.010 to 0.125 inch in diameter, the over-pressure employed ranged from about 1.8 to 20 psi, with higher pressures generally associated with smaller nozzle openings.

In the closed position, with gas flowing through the nozzle, no obstructions were observed to form. In the open position, with melt flowing through the nozzle, the molten jet was observed to remain stable, without signs of "twitching" as is commonly observed when obstructions form in the orifice. The appearance of the molten jet did not change throughout several interruptions of the jetting process.

2. A sealed crucible with stopper rod tapping assembly, substantially identical to that depicted in the Drawing, was constructed. The crucible was fabricated from graphite. The stopper rod, valve seat and nozzle were fabricated from boron nitride. A variety of melts were extruded, including $Fe_{40}Ni_{40}P_{14}B_6$ and $Fe_{32}Ni_{36}Cr_{14}P_{12}B_6$. The crucible was 13.44 inch long and 5.25 inch in diameter; wall thickness was 0.38 inch. The stopper rod was 6 inch long and 0.500 inch in diameter. The vent was 0.062 inch in diameter and the vent egress was 0.020 inch in diameter. The vent extended from above the surface of the melt to the bottom tip of the stopper rod. The stopper rod was raised and lowered pneumatically. Nozzle openings and gas (argon) over-pressures were similar to those employed in Example 1.

As with the crucible and stopper rod tapping assembly of Example 1, no obstructions were observed to form with the rod in the closed position. The appearance of the molten jet did not change through several interruptions of the jetting process.

What is claimed is:

1. Metal filament forming apparatus comprising:

a. a top-sealed crucible provided with a chamber adapted to contain molten metal and including a tapping orifice and nozzle in the bottom thereof;

b. means for introducing inert gas under pressure into the upper part of said chamber;

c. a stopper rod mounted in said crucible provided with an interior channel extending within the crucible from an egress vent in communication with said chamber above the surface of the molten metal to the bottom tip of the stopper rod;

d. means for raising and lowering the stopper rod so as to open and close the orifice; and e. a valve seat surrounding the orifice for seating the stopper rod and closing the orifice, whereby undesired residues are flushed from the orifice by the pressurized inert gas when the stopper rod is seated against the valve seat.

2. In a process for forming a filament by extruding molten metal through a tapping orifice in the bottom of a top-sealed crucible provided with a chamber containing the molten metal comprising opening the orifice by raising a stopper rod seated against a valve seat surrounding the tapping orifice and extruding the molten metal by over-pressure of an inert gas within said chamber, the improvement which comprises directing the inert gas through a channel provided in the interior of the stopper rod into the tapping orifice when the stopper rod is seated against the valve seat, said channel extending within the crucible from an egress vent in communication with said chamber above the surface of the molten metal to the bottom of the stopper rod, thereby flushing undesired residues from the tapping orifice.

* * * * *